United States Patent [19]

Bini et al.

[11] Patent Number: 4,796,389

[45] Date of Patent: Jan. 10, 1989

[54] RETICULAR SPATIAL STRUCTURE

[75] Inventors: Dante Bini, San Francisco, Calif.; Domenico Bogliari, Olmo, Italy; Sandro Lomoro, Rome, Italy; Daniele Minozzi, Padua, Italy; Stefano Pietrogrande, Rome, Italy; Dario Zucchi, Bologna, Italy

[73] Assignee: Binistar International N.V., Curacao, Netherlands Antilles

[21] Appl. No.: 55,955

[22] Filed: Jun. 1, 1987

[30] Foreign Application Priority Data

Jun. 5, 1986 [IT] Italy ..... 20687 A/86

[51] Int. Cl.[4] ..... E04H 14/00

[52] U.S. Cl. ..... 52/2; 52/63; 52/81; 52/745

[58] Field of Search ..... 52/81, 2; 135/102, 103; 403/171, 172, 408.1

[56] References Cited

U.S. PATENT DOCUMENTS

| | | | |
|---|---|---|---|
| 3,006,670 | 10/1961 | Schmidt | 52/81 |
| 3,129,531 | 4/1964 | Connor | 52/81 |
| 3,918,233 | 11/1975 | Simpson | 52/81 |
| 3,973,370 | 8/1976 | McAllister | 52/81 |
| 4,296,585 | 10/1981 | Bini | 52/81 |
| 4,442,059 | 10/1984 | Boyce | 52/81 |
| 4,455,803 | 6/1984 | Kornberger | 52/81 |
| 4,669,909 | 6/1987 | Inchaurbe | 403/171 |

*Primary Examiner*—Henry E. Raduazo

*Attorney, Agent, or Firm*—Guido Modiano; Albert Josif

[57] ABSTRACT

A reticular spatial structure comprising a plurality of perimetral rod-like elements which are associable, at their ends, with perimetral nodes; a plurality of variable-length rod-like elements hinged to connecting nodes having a spherical contact surface adapted to allow the rotation of at least part of the variable-length rod-like elements both about the axis of said elements and with respect to the geometrical center of the various nodes, for the extension of the variable-length elements during the raising of the framework which is preassembled on a base plane. A connecting node comprises a lower plate and an upper plate securing a covering membrane, which can be fixed to a rocker suspension pivot connected to a hollow body having both the outer surface and the inner surface in the shape of equatorial segments of concentric spheres. The hollow body is provided with openings for the insertion of the node-rode fixing bolts.

15 Claims, 5 Drawing Sheets

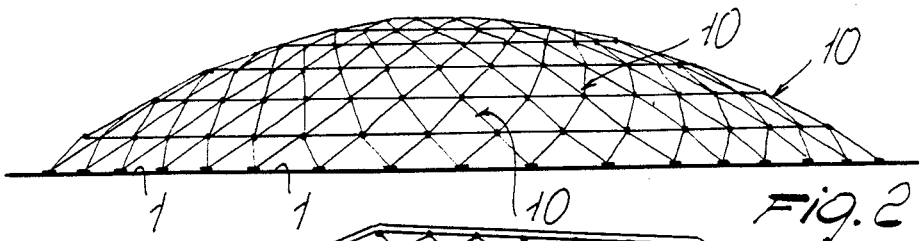
Fig. 2
Fig. 1
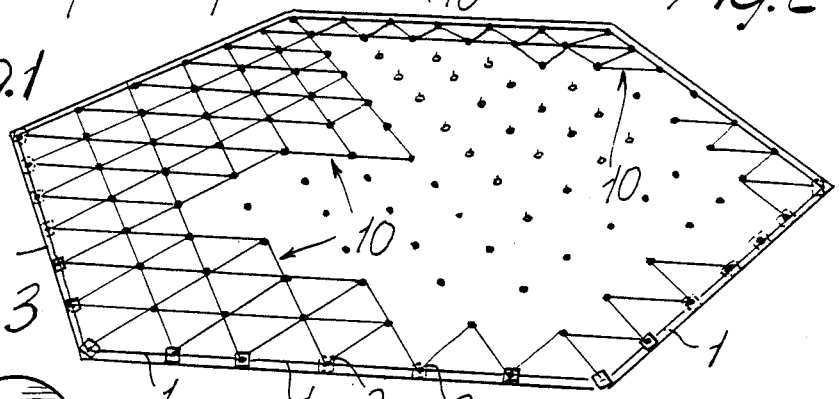
Fig. 3
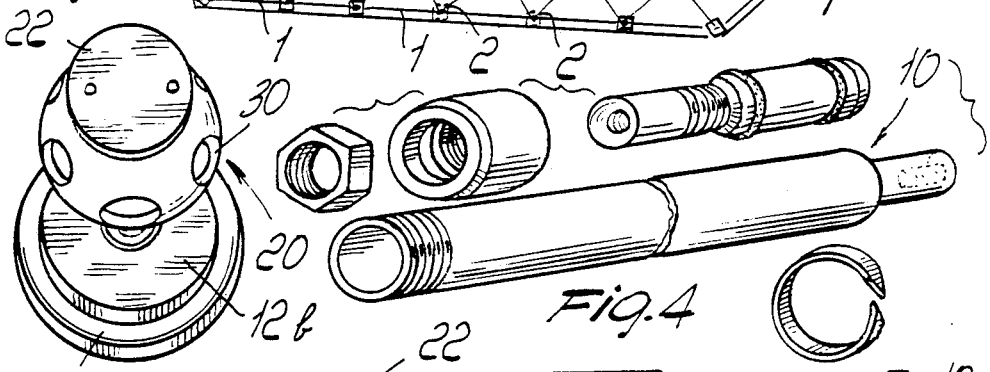
Fig. 4
Fig. 5
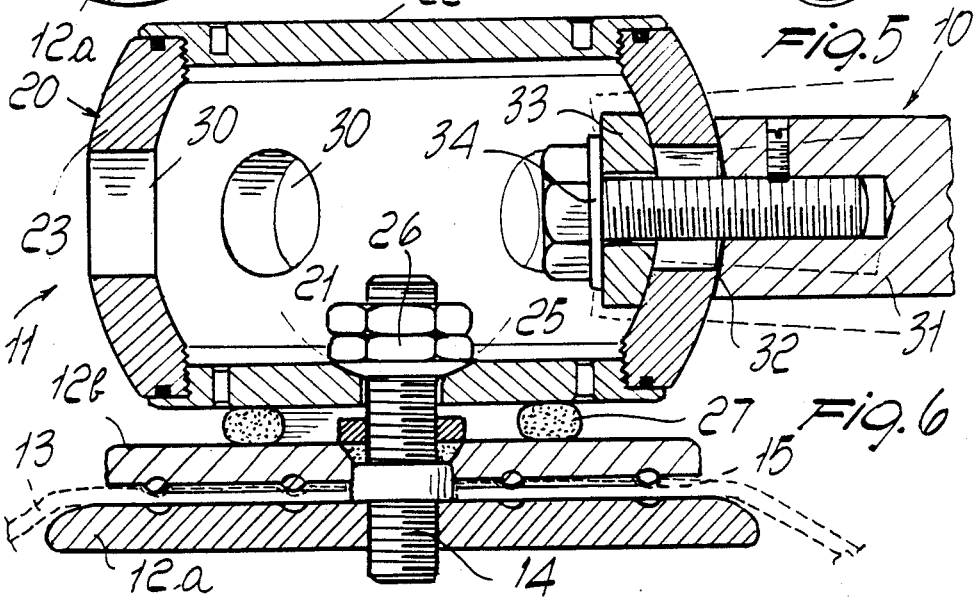
Fig. 6

10
11
31
40
41
42
43
44
45
46
47
48

RETICULAR SPATIAL STRUCTURE

BACKGROUND OF THE INVENTION

The present invention represents a particular apparatus related to a spatial structure which can be obtained, preferably but not necessarily, by means of a pneumatic lifting system and is composed of extendable modular elements, coupled to the nodes by means of spherical hollow hinges, all the elements being assembled on a substantially plane level on a membrane fixed to a perimetral foundation ridge or the like.

In a previous patent application (Italian application No. 49254 A/79 filed on May 30th, 1979, in the name of Dante Bini), which is included herein as reference, a method is illustrated for performing a covering, preferably domeshaped and pneumatically erected, which is substantially constituted by a plurality of rod-like elements which are assembled and connected at their end to non-spherical nodes and rigidly fixed to a membrane anchored peripherally on a planar surface which in practice delimits the covering region. In said application, variable-length rod-like elements are furthermore provided which are still assembled on a base plane, coupling their ends to connecting nodes, the rod-like elements having a limited possibility of articulation with respect to the nodes, during the phase of automatic raising. After connecting the various rod-like elements and the nodes by preassembling on a base plane, an erection of the supporting structure of the covering is provided by means of a pneumatic action or the like, acting on said membrane so that, in reaching the desired configuration, the variable-length rod-like elements extend telescopically until they reach a selected length, by rotating about their own axis, but not about the geometrical center of the node.

When the present length has been reached, locking means intervene which are directly provided in the rod-like elements, and prevent said elements from assuming a length which differs from the preset one.

With the above described arrangement, the various rod-like elements, assembled beforehand on a base plane, allow to achieve a precise automatic positioning thereof to provide a specific spatial structure substantially in the shape of a dome or of a vault and pneumatically erected.

In the above mentioned patent, the connection between the known rod-like elements of the non-spherical type is generally provided by means of complex elements with different shapes which lock into or insert in corresponding specifically provided seats.

The various embodiments illustrated in the previous patent have proved to be susceptible to improvement, especially regarding the possibility of allowing a complete freedom of articulation between each rod-like element and node, and the possibility of giving the absolute assurance of preserving the concentricity of the axes of all the rodlike elements with the corresponding geometrical centers of the nodes, no matter what the angle of incidence, furthermore allowing a remarkable constructive simplicity of the components.

Another limitation which can be found in the solution illustrated in said patent application resides in the fact that, especially in bad weather, the covering membrane, which is rigidly coupled to the assembly of the node, can transmit directly to the metallic structure stresses and vibrations which are capable of triggering moments which can be harmful to the local stability of the rod-node assembly, due to the lack of concentricity of the axes of the rods with respect to the geometrical center of the node as the angle of incidence of the axes of the rod-like elements varies with respect to the vertical axis which passes through the center of the nodes.

SUMMARY OF THE INVENTION

The aim of the invention is indeed to eliminate the above described disadvantages by providing a reticular structure for variable geometries, including the global ones which can be contained in spherical shapes and preferably with pneumatic forming, which offers the advantage of greatly facilitating all the steps of making the components, their assembly, raising the structure, disassembly of the components and their possible recovery for other purposes or future uses of the same structure.

Within the scope of the above described aim, a particular object of the present invention is to provide a reticular structure, provided with a more efficient and simplified perimetral anchoring/connection node for the various rod-like elements connected thereto and which, even when the structure is erected, can be replaced or makes it possible to replace or eliminate one or more rod-like elements connected thereto, with the possibility of facilitating their locking once the designed preset position has been reached.

The aim described above, as well as the objects mentioned and others which will become apparent hereinafter, are achieved by a reticular spatial structure preferably pneumatically erected, composed of modular elements, according to the invention, comprising a plurality of perimetral rod-like elements associable, at their ends, with perimetral nodes, a plurality of variable-length rod-like elements pivotable, at their ends, to connecting nodes provided, like the perimetral nodes, with a spherical contact surface adapted to allow the rotation of at least part of said variable-length rod-like elements both about the axis of said elements and with respect to the geometrical center of the various nodes, for the extension of said variable-length elements during the pneumatic raising of the framework preassembled on a substantially horizontal base plane for the formation of a reticular spatial structure, preferably but not necessarily in the shape of a dome, locking means being furthermore provided to prevent the return of said variable-length rod-like elements to lengths which differ from the intended final extension lengths, characterized in that said connecting nodes comprise a lower plate and an upper plate securing a pneumatic raising membrane used as covering and coupled to the interior of the connecting node suspended rocker-like to a hollow body having at least two concentric walls shaped like a spherical crown without the polar caps, said walls being provided with a plurality of openings in the equatorial regions which allow the rod-node connection, the locking of the ends of said rod-like elements being possible, once the pneumatic raising has occurred, since the interior of the node is accessible because of the lack of its upper cap or by removing a cover.

BRIEF DESCRIPTION OF THE DRAWINGS

Further characteristics and advantages will become apparent from the description of a number of preferred, but not exclusive, embodiments of a reticular spatial structure, illustrated only by way of non-limitative example in the accompanying drawings, where:

FIG. 1 is a schematic view of the structure according to the invention during the assembly phase, on a pneumatic seal membrane, on a plane before the erection to produce a preferred dome-like geometry, in this case with an hexagonal base;

FIG. 2 shows a schematic prospect of a dome with reticular spatial structure, according to the invention;

FIG. 3 is a schematic exploded perspective view of a connecting node;

FIG. 4 is an exploded perspective view of a variablelength rod-like element;

FIG. 5 is a view of an automatic locking means;

FIG. 6 is a diametral cross section view of a connecting node comprising the rocker supporting apparatus for the membrane and with the end of a rod-like element applied;

DESCRIPTION OF THE PREFERRED EMBODIMENTS

Figure 7:
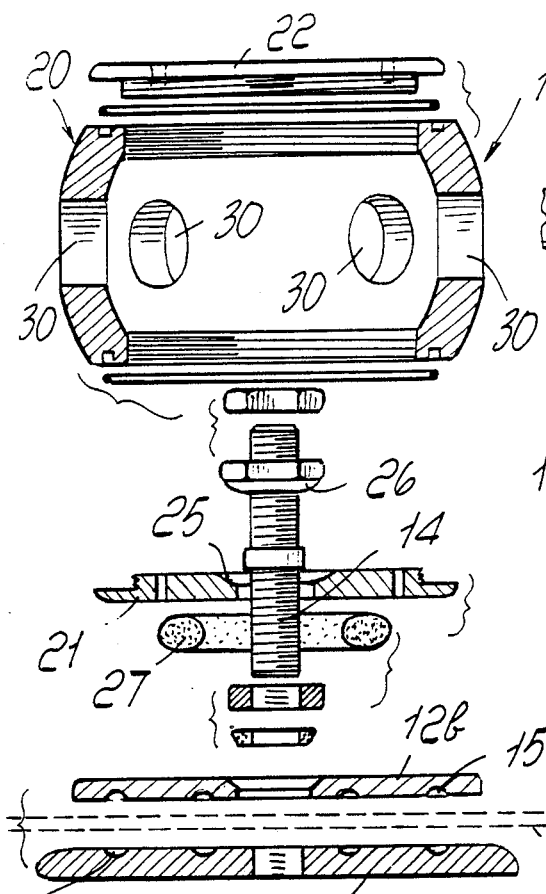
FIG. 7 is an exploded cross section view of a connecting node.
Figure 8:
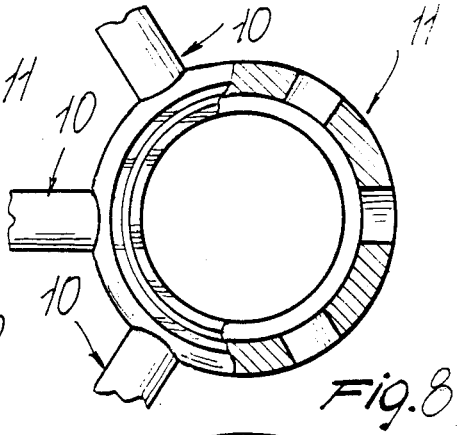
FIG. 8 is a plan view, in partial cross section, of a connecting node.
Figure 9:
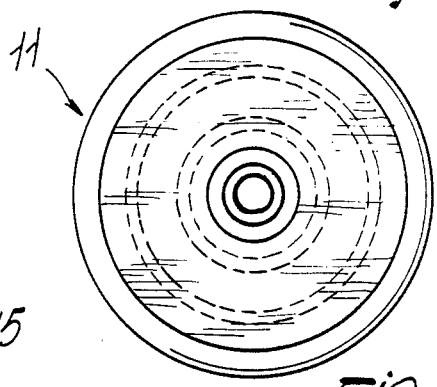
FIG. 9 is a view of a connecting node from the opposite side.
Figure 10:
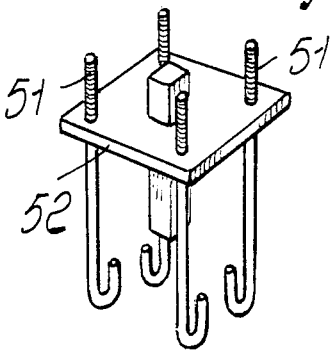
FIG. 10 is a schematic perspective view of a plinth for anchoring a perimetral node to the foundations.
Figure 11:
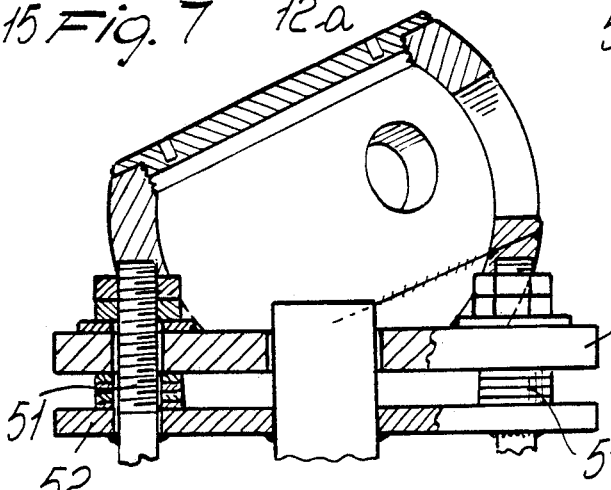
FIG. 11 is a cross section view of a perimetral node coupled to said plinth.
Figure 12:
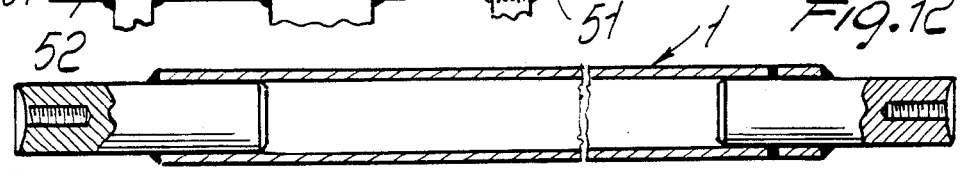
FIG. 12 is a partial cross section view of a perimetral rod-like element.

With reference to the above described figures, the pneumatically erected reticular spatial structure, according to the invention, comprises a plurality of perimetral rod-like elements, indicated by 1, which advantageously but not necessarily are of the fixed-length type, and at their ends are coupled to perimetral nodes, generally indicated by the reference numeral 2, after arranging the lower plates 12*a* on the resting plane according to the preset geometry.

As schematically indicated in FIG. 1, the structure is arranged on a base plane on a membrane 13, anchored peripherally to the pneumatically sealed foundations, arranging the rod-like elements 1 according to a geometrical pattern provided by the project and connecting them to the perimetral nodes.

The reticular structure, according to the invention, furthermore comprises variable-length rod-like elements, generally indicated by the reference numeral 10 which also, at their ends, are articulated to connecting nodes 11 with the possibility of rotating about their own axis of rotation with respect to the geometrical center of said connecting nodes; furthermore, part of the rod-like elements 10 are articulated also to the perimetral nodes 2, so as to create, in practice, a plane grid applied both to the membrane 13, at selected points, and to the perimetral foundation plinths.

As illustrated in detail in FIG. 6 and in the subsequent figures, the entire apparatus of the connecting node 11 is provided with a lower plate 12*a* and with an upper plate 12*b* securing the membrane 13 between themselves by means of a threaded connecting pivot 14 suspended, rockerlike, from the node.

For the sake of descriptive completeness, it should be furthermore added that the plates 12*a* and 12*b* are provided, on their face connecting the membrane 13, with annular recesses, indicated by 15, which facilitate the adhesion of the membrane to the plates, in order to ensure a waterproof connection.

The pivot 14 is suspended from the hollow body, indicated by 20, which is substantially composed of a lower base 21 and of an upper base 22 connected to a wall having the inner and outer surfaces shaped according to concentric spherical surfaces.

The lower base 21 defines, in the region of coupling to the pivot 14, a coupling seat 25 shaped like a spherical portion, in which a complementarily shaped nut 26 engages and allows a variable positioning of the hollow body 20 with respect to the pivot 14.

It should be furthermore added that a ring 26 of elastically deformable material is interposed between the lower base 21 and the upper plate 12 and acts as a shock absorber, absorbing part of the vibrations transmitted by the membrane to the metallic structure.

A plurality of openings 30 is provided on the wall 23 for the passage of the locking bolts 34 required to lock the ends of the rod-like elements 10. For this purpose, the rodlike elements 10 are provided with a terminal body 31 which defines a spherical seat 32 in the region of coupling to the wall 23 which has a curvature matching the curvature of the node spherical surface, so as to achieve a stable coupling also when the angle of the terminal body with respect to the node varies.

Similarly, inside the hollow body 20 a shaped body 33 is provided which has a spherical configuration in the region of contact to the inner surface, so as to ensure a perfect coupling also of the surfaces in contact inside the node, as the angle of incidence of the terminal body with respect to the node varies.

The upper base 22 is screwed to the hollow body 20 so as to be removable and to permit access to the bolts 34 for the final locking in the preset position of the various rodlike elements once their extension is completed to reach the preset length after the structure has been erected.

The structure can be raised, as previously mentioned, by pneumatic means, but conceptually nothing varies if it is raised by means different from pneumatic ones, such as for example, by means of cables, jacks or other mechanical systems.

The various variable-length rod-like elements 10 have a tubular body, indicated by 40, which, at least at one end, defines a threaded portion 41 with which a ring nut 42 engages. The ring nut 42 is provided with an abutment 43, which, in cooperation with the end of the tubular body 40, defines the snap coupling seat 44 for a locking means which is advantageously constituted by a split elastic ring 45 housed in a piston-like body 46 which is slideable within the tubular body 10. The elastic ring 45 is positioned on the body 46 on the opposite side with respect to the terminal body 31

A threaded portion 47 is provided in the region of coupling between the piston body 46 and the terminal body 31, and a locking nut 48 is engaged therein once the desired extension has been performed.

Figures 13, 14, 15, 16:
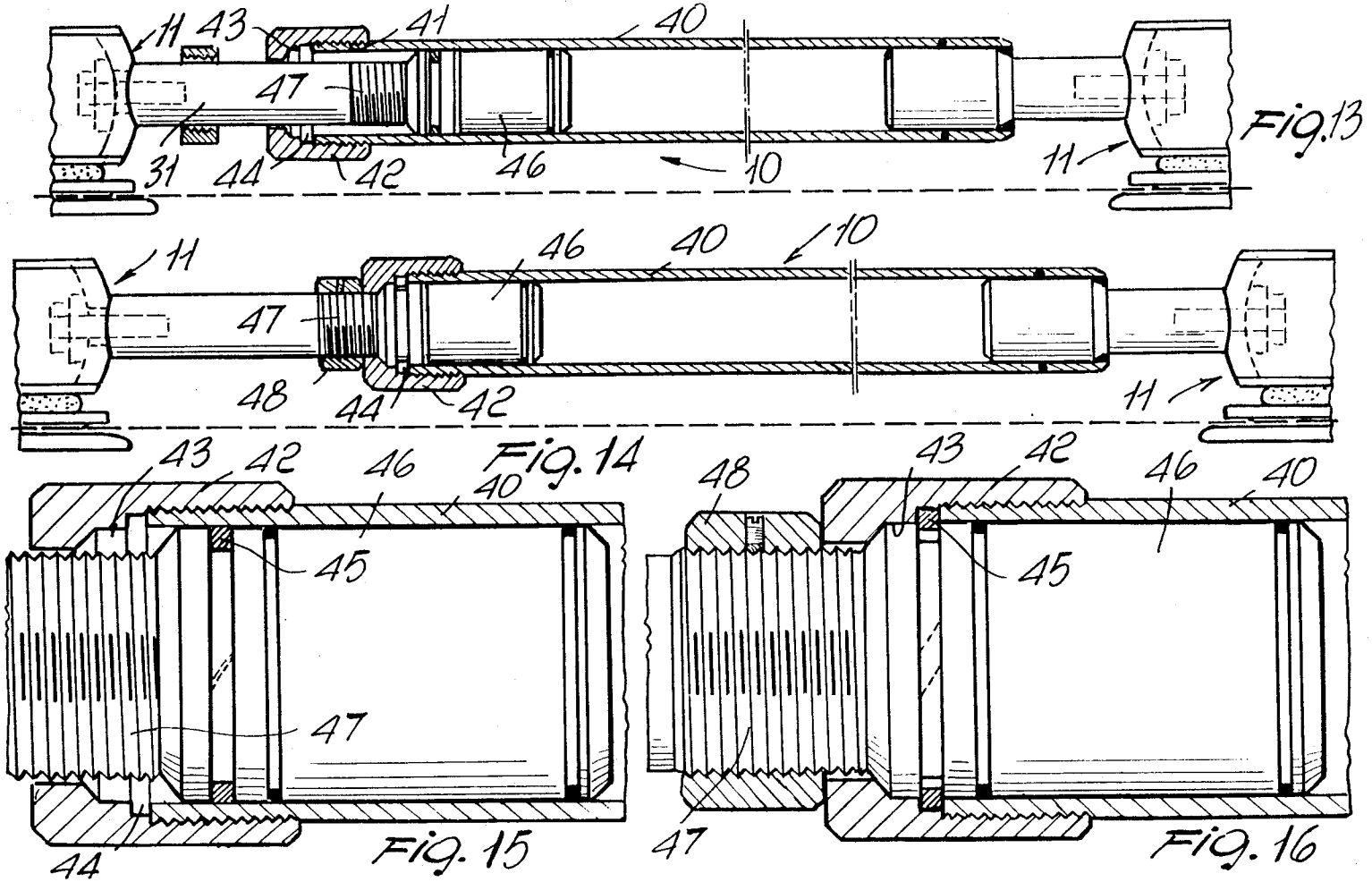
FIG. 13 is a cross section view of a variable-length rod-like element before its extension in length.
FIG. 14 is a cross section view of a rod-like element once it has reached its preset working length.
FIGS. 15 and 16 are enlarged scale views of the locking means respectively before and after the extension has occurred.

In practice, as is better illustrated in FIGS. 13 and 14, in assembly conditions the piston-like body 46 is housed in the tubular body 40 and supports the elastic ring 45.

Once the the rod-like element has been extended following the raising of the structure pneumatically or by other means, the ring locks in the coupling seat 44 defined by the abutment 43 and by the end of the tubular body 40 thus preventing any further axial motion of the tubular body with respect to the piston-like body.

Figure 18:
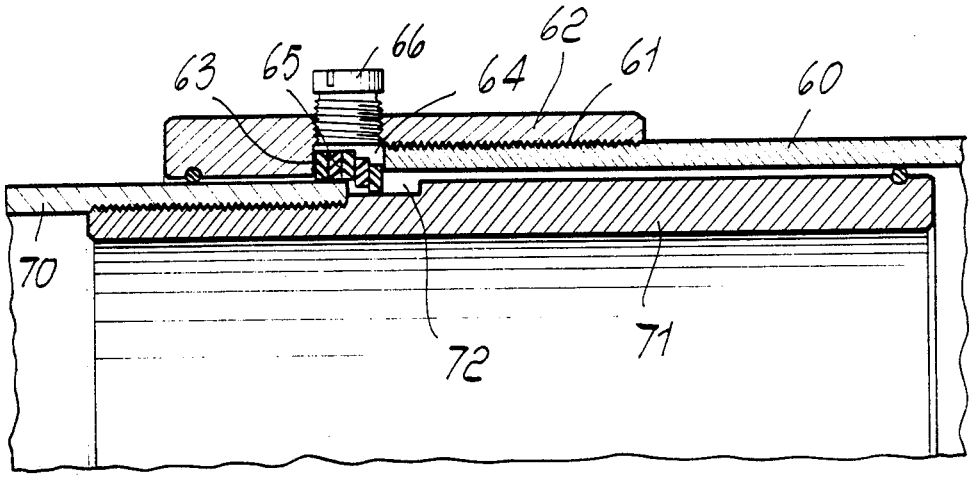
FIG. 18 is a detailed view of the rod-like element illustrating the locking means during their action phase.
Figure 19:
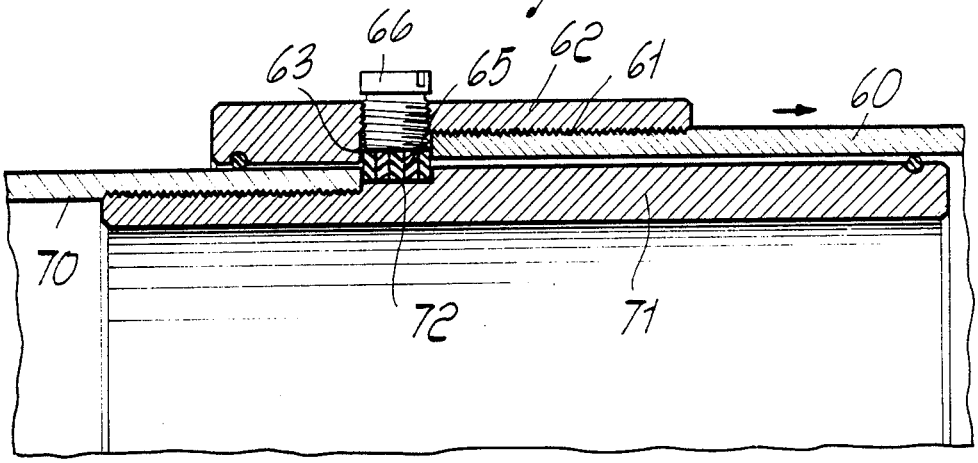
FIG. 19 is a view of the locking means once the locking has occurred.
Figure 17:
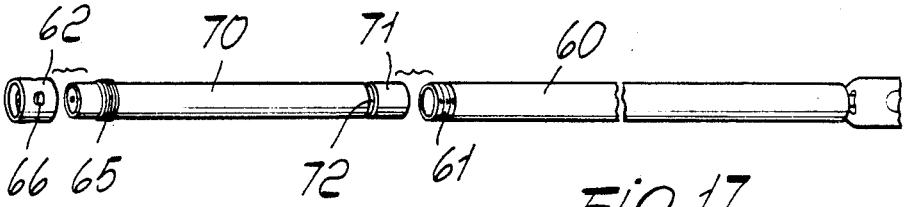
FIG. 17 is an exploded perspective view of another aspect of the rod-like element with variable working length.

In FIGS. 17, 18 and 19, it is illustrated a rod-like element with variable working length, according to another aspect of the invention.

In practice, an outer tubular body 60 has, at one of its ends, an outer threaded portion 61 engaging a sleeve 62 which inwardly defines an abutment or sleeve abutment 63 delimitating, with the end of the outer tubular body 60, a seat 64 in which split elastic rings 65 are provided acting in compression. On the elastic rings 65 act the threaded means 66 arranged outside the sleeve 62 to radially compress the rings 65.

An inner tubular body 70 is accommodated inside the tubular body 60 and defines a piston-like portion 71 providing a locking seat 72 in which said elastic rings 65 are locked to prevent the reentry of the inner tubular body 70 once it has been extended to the preset length.

Figure 20:
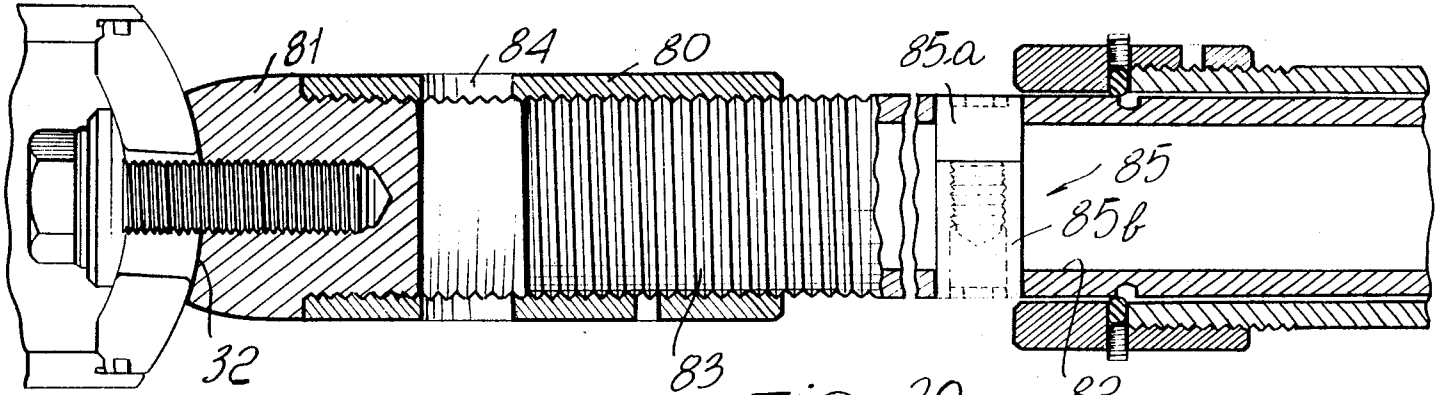
FIGS. 20 and 21 are views of the attachment body of the rod-like elements with a device for performing the final extension.
Figure 21:
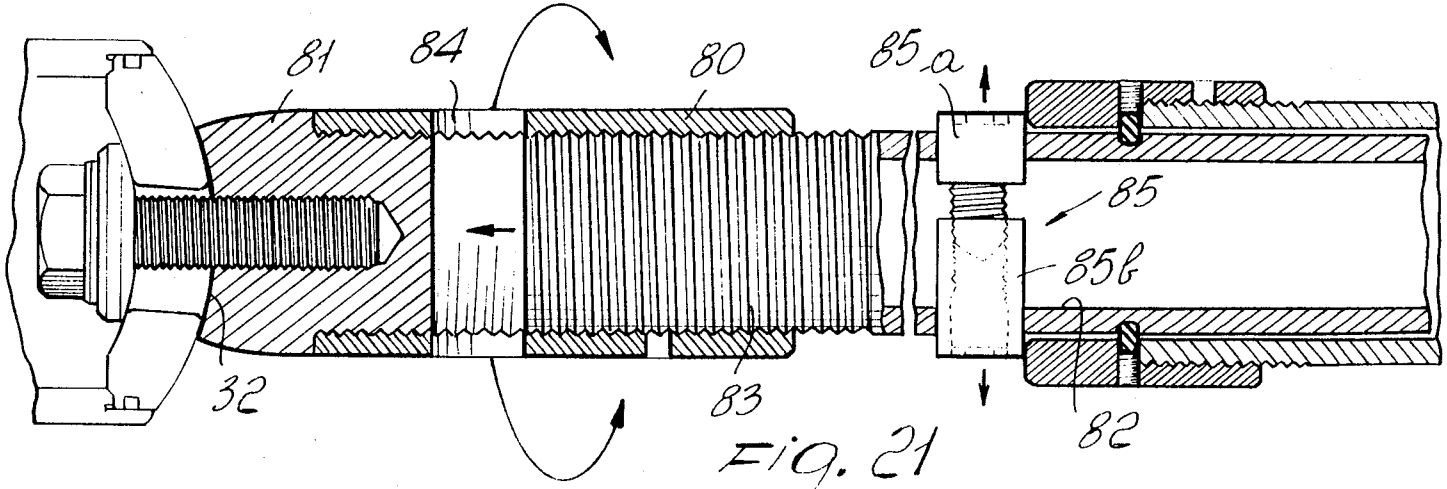

In some cases, it may happen that the rod-like elements cannot extend completely to reach the preset length, so that the elastic locking rings do not insert in the related seat; to make this insertion possible in any case, a device for performing the final extension can be provided as illustrated in FIGS. 20 and 21.

Such a device comprises a threaded sleeve 80 which is connected to the terminal body 81 and engages rotatably with a threaded portion 83 defined by the tubular element 82.

The threaded sleeve 80 is provided with a diametral hole 84 which is engageable by a tool to rotate the sleeve so as to "pull" the tubular element 82 until the snaptogether coupling of the elastic rings is achieved.

Furthermore, an element for locking the reentry of the tubular element 82 is provided, which consists of a diametral body 85 diametrally supported by the tubular element 82. The body 85 has a minimum length such as to be included in the dimensions of the tubular element 82 and is extendable to engage in abutment with the sleeve provided on the outer tubular element. For this purpose, the body 85 is composed of a first part **85*a* and of a second part 85*b*** with a mutual coupling of the bolt-threaded seat type.

It should be furthermore added that the perimetral nodes 2 can be made similar to the nodes 11, assembling them in such a way as to make them capable of oscillating in order to assume the correct position, or possibly a hollow body 20 can be fixed with a preset inclination to an upper base plate 50 which, by means of the locking tension elements 51, locks onto a lower base plate 52 which can be connected to a plinth for anchoring to the ground or to the perimetral foundation ridge.

In practice, in the assembly, after arranging the suspension plates **12*a* on the resting plane, a plane reticular structure is applied to a membrane 13 which is peripherally anchored and pneumatically sealed, by connecting to one another the perimetral nodes of the foundations of the rod-like elements 1, as well as variable-length rod-like elements 10 to the connecting nodes, according to a preset pattern, then air is forced below the membrane, performing the gradual raising, which, as already mentioned above, can also be achieved with different means During the raising of the structure, the rod-like elements 10** extend and rotate both about their own axis and about the various geometrical centers of the connecting nodes until, once the preset working length has been reached the rod-like elements lock at the set position.

Once the desired structural configuration has been achieved, the ring nuts of the locking nuts and of the various rod-like elements are tightened, and then the rod-like elements are locked with respect to the nodes by using the bolt 14 which can be reached from the interior of the hollow body 20, thus achieving also the locking at all the nodes.

From what has been described, it can be seen that the invention achieves the proposed aims, and in particular the fact is stressed that the reticular structure, according to the invention, has a remarkably easy assembly, due to the presence of components similar to one another, composed of nodes and variable-length rod-like elements, which have the possibility of reaching a preset length during the pneumatic raising.

Moreover, the system makes it possible to release quickly the various lockings in order to recover the elements at a substantially plane level, preferably through a pneumatic disassembly.

It is furthermore specified that the variable-length rod-like elements can be provided, according to the requirements, either with both ends extendable or with one fixed end and with one extendable end.

It has been furthermore observed that it is possible to use a limited variety of rod-like elements since the various rod-like elements all have the same central portion constituted either by the tubular body 40 or by the outer tubular body 60 and, according to the working length needed, just the length of the terminal body 31 has to be modified.

The invention thus conceived is susceptible to numerous modifications and variations, all of which are within the scope of the inventive concept.

Moreover, all the details may be replaced with technically equivalent elements.

In practice, the materials employed, so long as compatible with the specific use, as well as the dimensions and the contingent shapes, may be any according to the requirements.

We claim:

1. Reticular spatial structure comprising; perimetral nodes, a plurality of perimetral rod-like elements having ends, said ends being associated with said perimetral nodes, connecting nodes defining a geometrical center and each comprising a lower plate, an upper plate, and a hollow body having an inner surface and an outer surface, a plurality of variable-length rod-like elements having ends and axes, said ends being hingeable to said connecting nodes to form a framework, at least part of said variablelength rod-like elements being rotatable both about said axes and with respect to said geometrical center of said connecting nodes for causing extension of said variablelength elements to a final selected extension length during raising of said framework to form a reticular spatial structure having a dome-like shape, said structure further comprising;

node rod fixing bolts adapted for fixing said rod-like elements to said nodes locking means adapted to prevent return of said rod-like elements to a length which is different from said final selected extension length, a rocker suspension pivot connected to each said hollow body, and a covering membrane held by said lower plate and said upper plate of each of said connecting nodes and coupled to said rocker suspension pivot, wherein said inner surface and said outer surface of said hollow body are shaped as equatorial segments of concentric spheres, and wherein said hollow body has a wall inscribed by said two concentric spheres and provided with a plurality of openings, said openings being arranged radially for allowing insertion of said node-rod fixing bolts and for achieving structural continuity of said structure after pneumatic raising thereof.

2. Reticular spatial structure according to claim 1, wherein said lower plate and said upper plate are mutually locked together by means of a locking nut, said locking nut being engageable with said rocker suspension pivot.

3. Reticular spatial structure according to claim 1, wherein said plates have sides, said sides being directed towards said membrane and provided with annular recesses, said annular recesses being arranged concentrically.

4. Reticular spatial structure according to claim 1, wherein said hollow body has an upper base and a lower base, and wherein said hollow body defines a spherical crown, said lower base and said upper base being removably associable with said spherical crown.

5. Reticular spatial structure according to claim 4, wherein said lower base inwardly defines a seat, said seat having a spherical portion shape and being engageable with a nut, said nut being connected to said rocker suspension pivot, said rocker suspension pivot having a complementary spherical shape for permitting a rocker-like motion of said membrane with respect to said hollow body.

6. Reticular spatial structure according to claim 4, further comprising a spacer ring, said spacer ring being located between said upper plate and said lower base and made of elastically resilient shock-absorbing material.

7. Reticular spatial structure according to claim 1, wherein each of said ends of said rod-like elements has at least one terminal body, said terminal body being adapted for connection to said outer surface and having formed thereon a recess, said recess being shaped substantially like a spherical portion to match said outer surface of said hollow body, said structure further comprising locking bolts, said locking bolts being accessible from inside said hollow body.

8. Reticular spatial structure according to claim 7, wherein each locking bolt comprises a shaped body, said shaped body being interposed between said outer surface of said hollow body and said locking bolt, said shaped body defining a region of coupling to said inner surface of said hollow body, said region having a substantially spherical configuration complementary to said inner surface.

9. Reticular spatial structure according to claim 7, wherein said rod-like elements each comprise a tubular body, said tubular body having, at least at one end and a threaded region, said threaded region being adapted for engagement with a locking ring nut, said locking ring nut having formed thereon at least one abutment, said tubular body internally slideably accommodating a piston-like body, said piston-like body supporting said locking means and being connected to said terminal body, said locking means comprising at least one elastic ring, said elastic ring being insertable in a coupling seat, said coupling seat being defined between said end of said tubular body and said abutment.

10. Reticular spatial structure, according to claim 7, wherein said terminal body has a threaded portion, said threaded portion being adapted for engagement with a locking ring nut, said locking ring nut being adapted for fixing said rod-like element to a preset length upon erection of said structure.

11. Reticular spatial structure according to claim 1, wherein said rod - like elements each comprise an outer tubular body having an end and an outer threading, said outer threading being adapted for coupling with a sleeve, said sleeve defining a sleeve abutment, said sleeve abutment and said end of said tubular body together defining a seat, said seat being adapted for at least partially accommodating at least one split elastic ring, said structure further comprising screw means, said screw means being accessible externally of said sleeve and adapted for compressing said split elastic ring, inside said outer tubular body there being slideably accommodated an inner tubular body, said inner tubular body defining a piston-like portion, said piston-like portion having formed thereon a locking seat, said locking seat being adapted for at least partially accommodating said at least one split elastic ring.

12. Reticular structure according to claim 11, further comprising a device for performing final extension of said rod-like element comprising a threaded sleeve, said inner tubular body having formed thereon a threaded portion, said threaded sleeve being connected to said terminal body and rotatably engaging said threaded portion of said inner tubular body.

13. Reticular structure according to claim 11, further comprising a means for performing final extension of said rod-like element, said means comprising a threaded sleeve, said inner tubular body having formed thereon a threaded portion, said threaded sleeve being connected to said terminal body, rotatably engaging said threaded portion of said inner tubular body, and and having formed therein a diametral hole, said diametral hole being adapted for engagement with a tool.

14. Reticular structure, according to claim 11, further comprising a diametral body, said diametral body being supported by said inner tubular body and defining a minimum length, said inner tubular body having a diameter, said minimum length being at most equal to said diameter of said inner tubular body, said diametral body being extendable to engage in abutment with said outer tubular body for blocking reentry of said inner tubular body into said rod-like element.

15. Reticular spatial structure according to claim 9, wherein said hollow body has an upper base and a lower base, and wherein said hollow body defines a spherical crown, said lower base and said upper base being removably associable with said spherical crown, said lower base inwardly defining a seat, said seat having a spherical portion shape and being engageable with a nut, said nut being connected to said rocker suspension pivot, said rocker suspension pivot having a complementary spherical shape for permitting a rocker-like motion of said membrane with respect to said hollow body, said rod - like elements each comprising an outer tubular body having an end and an outer threading, said outer threading being adapted for coupling with a sleeve, said sleeve defining a sleeve abutment, said sleeve abutment and said end of said tubular body together defining a seat, said seat being adapted for at least partially accommodating at least one split elastic ring, said structure further comprising screw means, said screw means being accessible externally of said sleeve and adapted for compressing said split elastic ring, inside said outer tubular body there being slideably accommodated at inner tubular body, said inner tubular body defining a piston-like portion, said piston-like portion having formed thereon a locking seat, said locking seat being adapted for at least partially accommodating said at least one split elastic ring, said reticular structure further comprising means for performing final extension of said rod-like element, said means comprising a threaded sleeve, said inner tubular body having formed thereon a threaded portion, said threaded sleeve being connected to said terminal body, rotatably engaging said threaded portion of said inner tubular body, and having formed therein a diametral hole, said diametral hole being adapted for engagement with a tool.

* * * * *